US006167784B1

(12) United States Patent
Lin

(10) Patent No.: US 6,167,784 B1
(45) Date of Patent: Jan. 2, 2001

(54) SPANNER WITH TORSION SPRING

(76) Inventor: Ching-Chang Lin, No. 64, Ching-Wu-Tung Rd., Taichung City (TW)

( * ) Notice: Under 35 U.S.C. 154(b), the term of this patent shall be extended for 0 days.

(21) Appl. No.: 09/390,948

(22) Filed: Sep. 7, 1999

(51) Int. Cl.[7] ..... B25B 13/28

(52) U.S. Cl. ..... 81/99

(58) Field of Search ..... 81/99, 111, 97, 81/103

(56) References Cited

U.S. PATENT DOCUMENTS

| | | | | |
|---|---|---|---|---|
| 728,945 | * | 5/1903 | Levy | 81/99 |
| 1,333,174 | * | 3/1920 | Henry | 81/99 |
| 1,486,981 | * | 3/1924 | Magnan | 81/99 |
| 2,742,808 | * | 4/1956 | Haberle | 81/99 |
| 2,875,659 | * | 3/1959 | Haberle | 81/99 |
| 2,958,246 | * | 11/1960 | Osborn | 81/99 |

* cited by examiner

*Primary Examiner*—Eileen P. Morgan
*Assistant Examiner*—Joni B. Danganan
(74) *Attorney, Agent, or Firm*—Merchant & Gould P.C.

(57) ABSTRACT

A spanner includes first and second clamping members. The first clamping member has a handle portion and a first jaw portion with a pivot plate portion that has a first pivot hole formed through top and bottom surfaces thereof. The second clamping member has a second jaw portion and a pair of pivot lobes which cooperatively define a receiving space therebetween to permit the pivot plate portion to extend thereinto and which are formed with second pivot holes aligned axially with the first pivot hole. A pivot shaft extends through the first and second pivot holes for mounting pivotally the second clamping member on the first clamping member. A torsion spring is sleeved on the pivot shaft, and is disposed in the receiving space for biasing the second jaw portion to move toward the first jaw portion. One of the top and bottom surfaces of the pivot plate portion is formed with a recess confining wall that defines a recess around the first pivot hole for receiving the torsion spring so that the torsion spring is concealed by the recess confining wall. The receiving space has a width which is measured between confronting inner surfaces of the pivot lobes and which is substantially equal to the thickness of the pivot plate portion measured between the top and bottom surfaces of the pivot plate portion.

3 Claims, 9 Drawing Sheets

SPANNER WITH TORSION SPRING

BACKGROUND OF THE INVENTION

1. Field of the Invention

The invention relates to a spanner, more particularly to a spanner with an enhanced strength and an enhanced clamping effect on a workpiece.

2. Description of the Related Art

FIGS. 1 to 3 illustrate a conventional spanner for operating a workpiece, such as a screw fastener. The spanner is shown to include an elongated first clamping member 10, a second clamping member 11, a pivot shaft 14, and a torsion spring 13. The first clamping member 10 has a handle portion 12 and a first jaw portion 121 at a front end of the handle portion 12. The first jaw portion 121 has a toothed first clamping face 122, and a pivot plate portion 123 with a reduced thickness relative to the handle portion 12. The pivot plate portion 123 has a first pivot hole 124 formed through top and bottom surfaces thereof, and an insert hole 125 formed in the top surface adjacent to the pivot hole 124. The second clamping member 11 has a second jaw portion 117 with a toothed second clamping surface 112, and a pair of spaced-apart pivot lobes 114 extending from the second jaw portion 117 to define an opening 111 with the second jaw portion 117. The pivot lobes 114 are formed with aligned second pivot holes 115, and cooperatively define a receiving space 113 to permit extension of the pivot plate portion 123 thereinto so as to align the first pivot hole 124 with the second pivot holes 115. The pivot shaft 14 extends through the first and second pivot holes 124, 115 for mounting pivotally the first clamping member 10 on the second clamping member 11. The second clamping surface 112 confronts the first clamping surface 122. The torsion spring 13 is sleeved on the pivot shaft 14, and is disposed between the pivot lobes 114. The torsion spring 13 has a first leg 131 at one end, and a second leg 132 at the other end. The first leg 131 is inserted into the insert hole 125 for retention at the pivot plate portion 123 of the first clamping member 10. The second leg 132 extends out of the receiving space 113, and is retained at a retaining slit 116 formed in an outer surface of the second clamping member 11 adjacent to the receiving space 113. As shown in FIG. 4, in use, the second clamping member 11 is moved pivotally about the pivot shaft 14 against the biasing action of the torsion spring 13 so as to move the second jaw portion 117 away from the first jaw portion 121 such that a clamping space 15 is formed between the first and second clamping surfaces 122, 112 to permit extension of a workpiece 20, such as a screw fastener, thereinto. The torsion spring 13 biases the second jaw portion 117 toward the first jaw portion 121 such that the workpiece 20 can be clamped tightly between the first and second clamping surfaces 122, 112, thereby permitting operation, such as turning, of the workpiece 20 via the spanner.

However, it is noted that the conventional spanner suffers from the following disadvantages:

(1) Since the torsion spring 13 is received in the receiving space 113, together with the pivot plate portion 123 of the first clamping member 10, a clearance 16 should be formed between the pivot plate portion 123 and one of the pivot lobes 114 for accommodating the torsion spring 13. Therefore, the pivot plate portion 123 of the first clamping member 10 should be reduced in thickness. The strength of the pivot plate portion 123 is thus reduced.

(2) As the thickness of the pivot plate portion 123 is reduced, the surface area of the first clamping surface 122 is reduced accordingly, thereby adversely affecting the clamping effect of the spanner on the workpiece 20.

(3) As the second leg 132 of the torsion spring 13 extends out of the receiving space 113, it is likely to be moved by an adjacent article when the spanner is operated, thereby affecting operation of the torsion spring 13.

SUMMARY OF THE INVENTION

Therefore, the object of the present invention is to provide a spanner that is capable of solving the aforementioned problems.

Accordingly, the spanner of the present invention includes an elongated first clamping member, a second clamping member, a pivot shaft, and a torsion spring. The first clamping member has a first jaw portion and a handle portion connected to the first jaw portion. The first jaw portion has a pivot plate portion with top and bottom surfaces and a first pivot hole formed through the top and bottom surfaces. The pivot plate portion of the first clamping member has a thickness measured between the top and bottom surfaces. The second clamping member has a second jaw portion and a pair of pivot lobes connected to the second jaw portion. The pivot lobes cooperatively define a receiving space therebetween to permit the pivot plate portion of the first clamping member to extend thereinto. Each of the pivot lobes is formed with a second pivot hole that is aligned axially with the first pivot hole. Each of the pivot lobes has an inner surface that confronts the other one of said pivot lobes. The receiving space has a width which is measured between the inner surfaces of the pivot lobes. The pivot shaft extends through the first and second pivot holes for mounting pivotally the second clamping member on the first clamping member. The torsion spring is sleeved on the pivot shaft, and is disposed in the receiving space for biasing the second jaw portion of the second clamping member to move toward the first jaw portion of the first clamping member. One of the top and bottom surfaces of the pivot plate portion of the first clamping member is formed with a recess confining wall that defines a recess around the first pivot hole. The torsion spring is received in the recess so as to be concealed by the recess confining wall, and has a first end retained at the first clamping member and a second end retained at the second clamping member. The width of the receiving space of the second clamping member is substantially equal to the thickness of the pivot plate portion of the first clamping member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
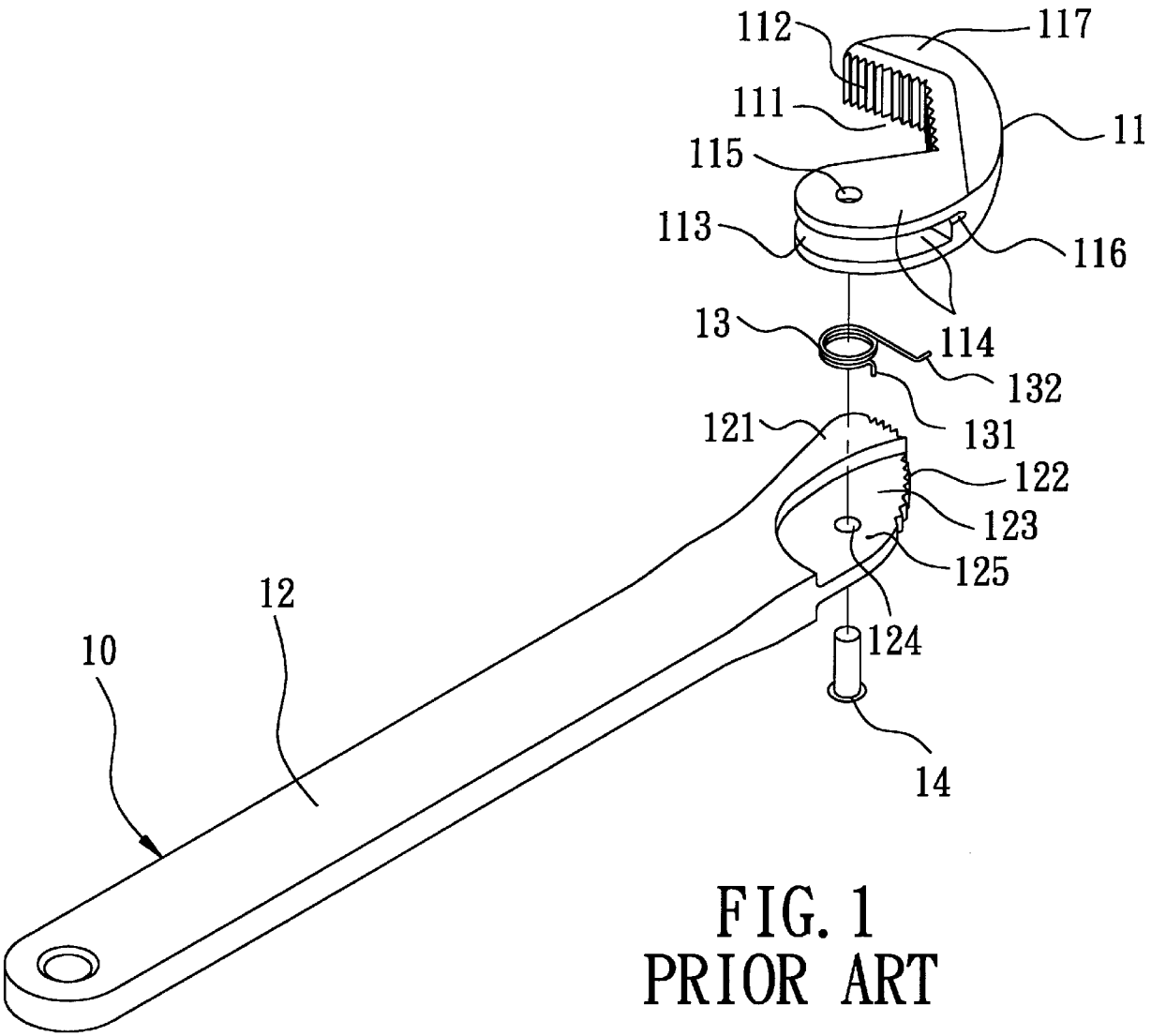
FIG. 1 PRIOR ART
FIG. 1 is an exploded perspective view of a conventional spanner.
Figure 2:
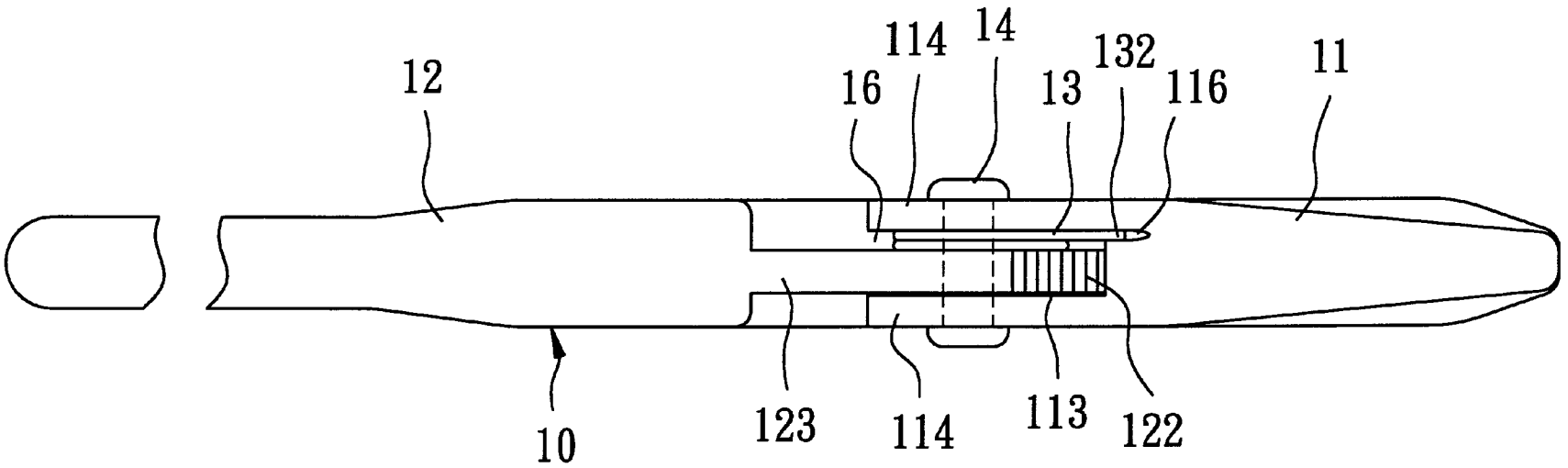
FIG. 2 PRIOR ART
FIG. 2 is a schematic side view of the conventional spanner.
Figure 3:
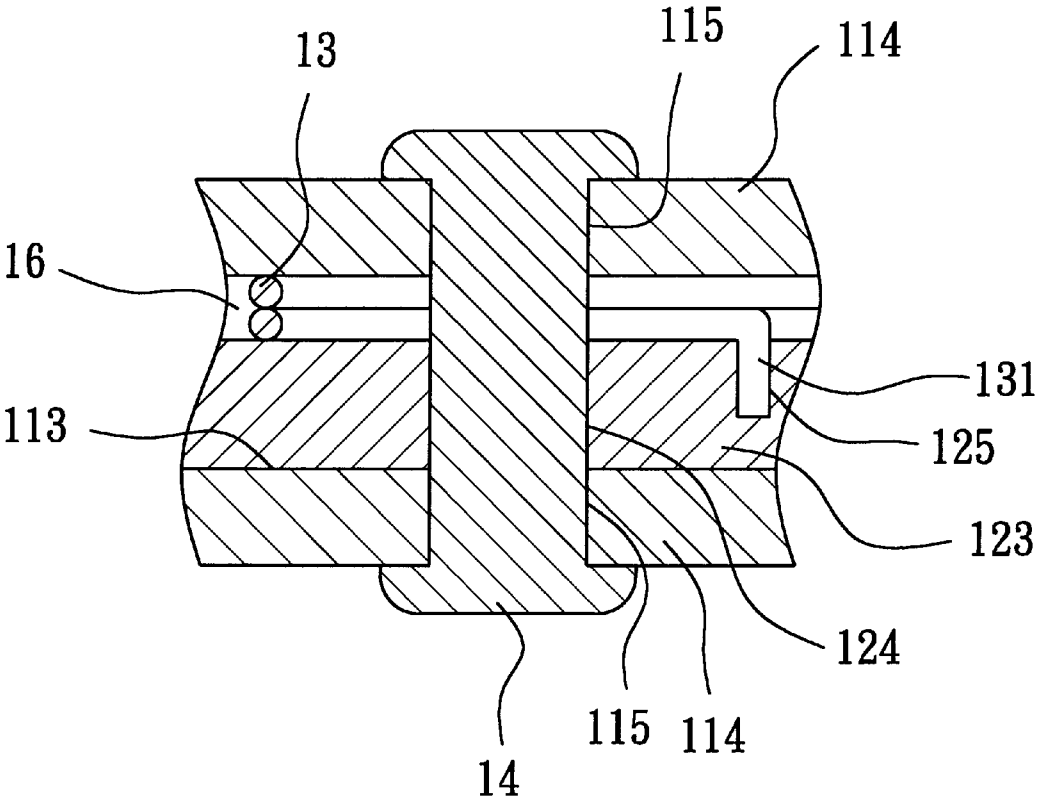
FIG. 3 PRIOR ART
FIG. 3 is an enlarged, fragmentary sectional view of the conventional spanner.
Figure 4:
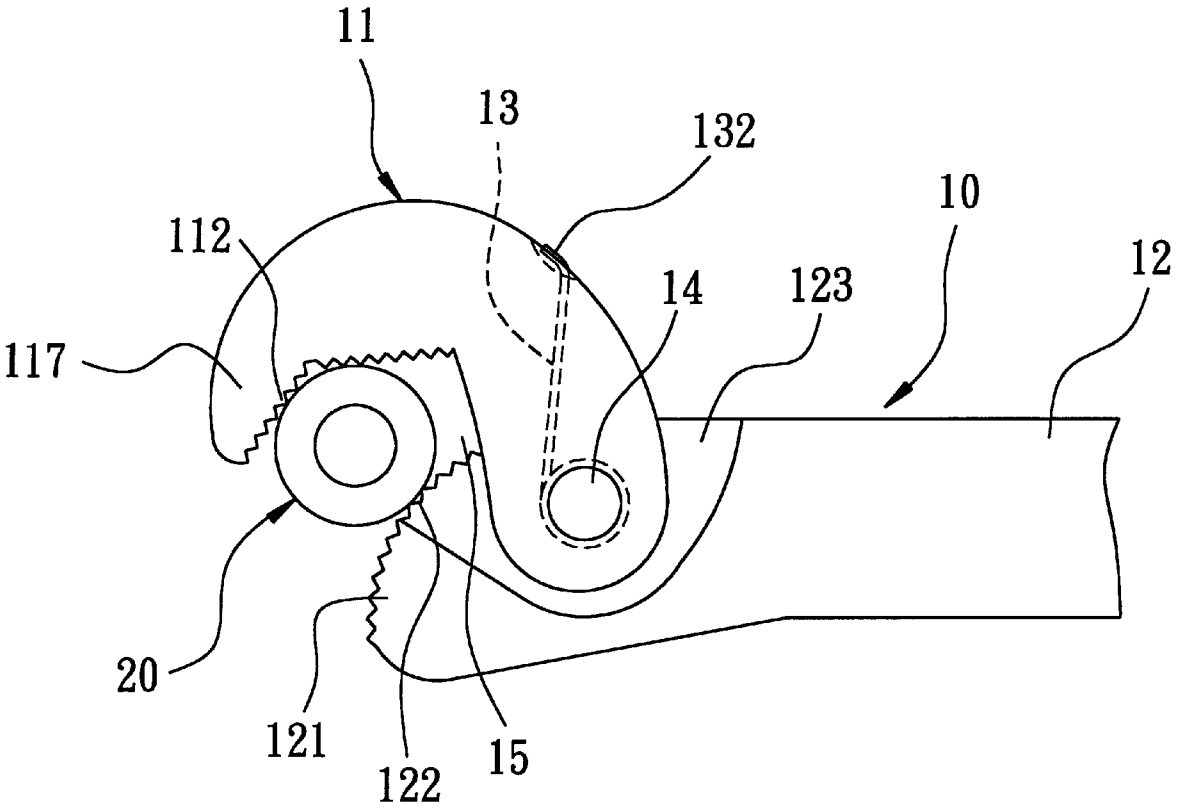
FIG. 4 PRIOR ART
FIG. 4 is a fragmentary schematic view illustrating the conventional spanner when in use.
Figure 5:
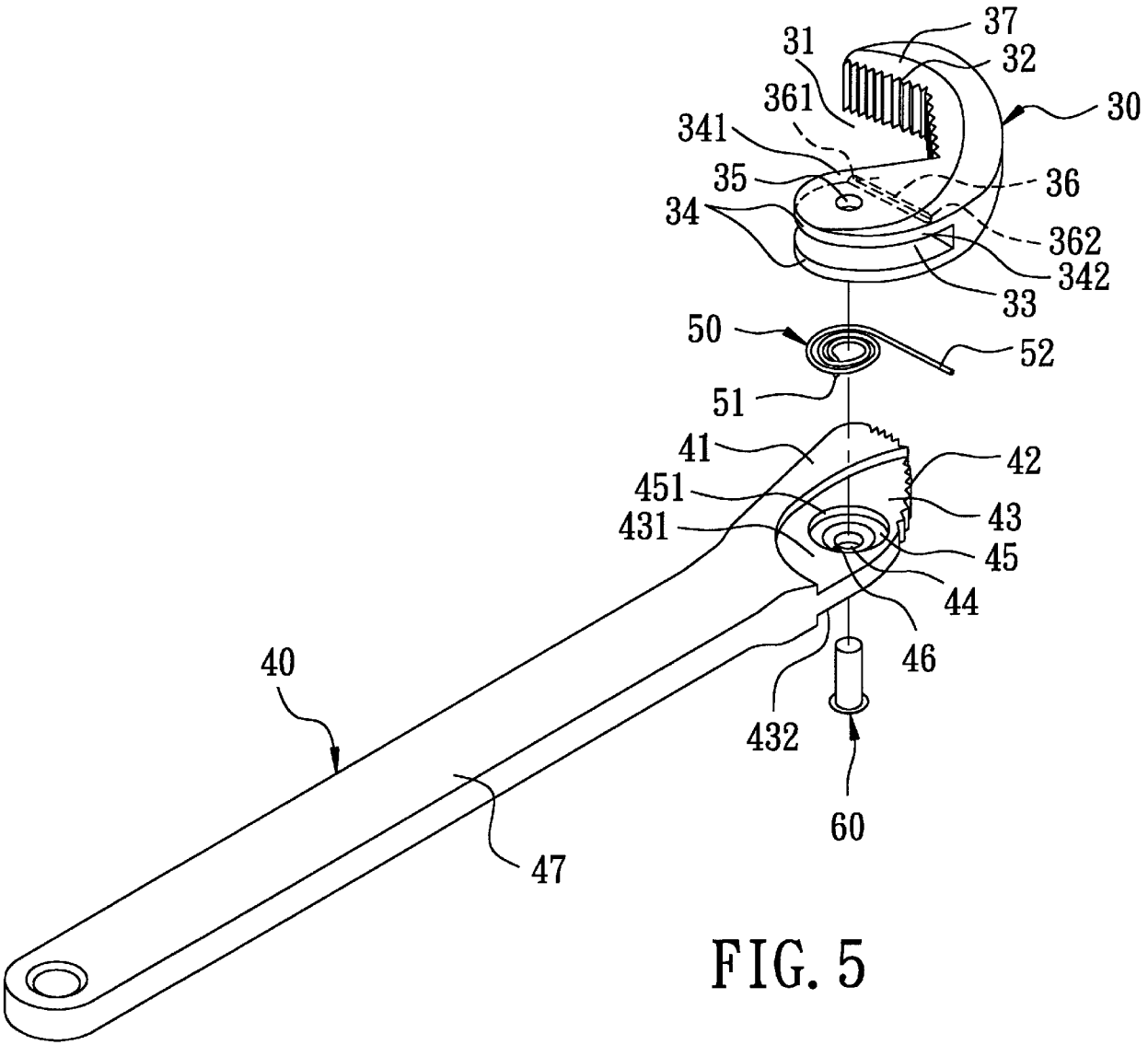
FIG. 5 is an exploded perspective view of a preferred embodiment of a spanner according to the present invention.
Figure 6:
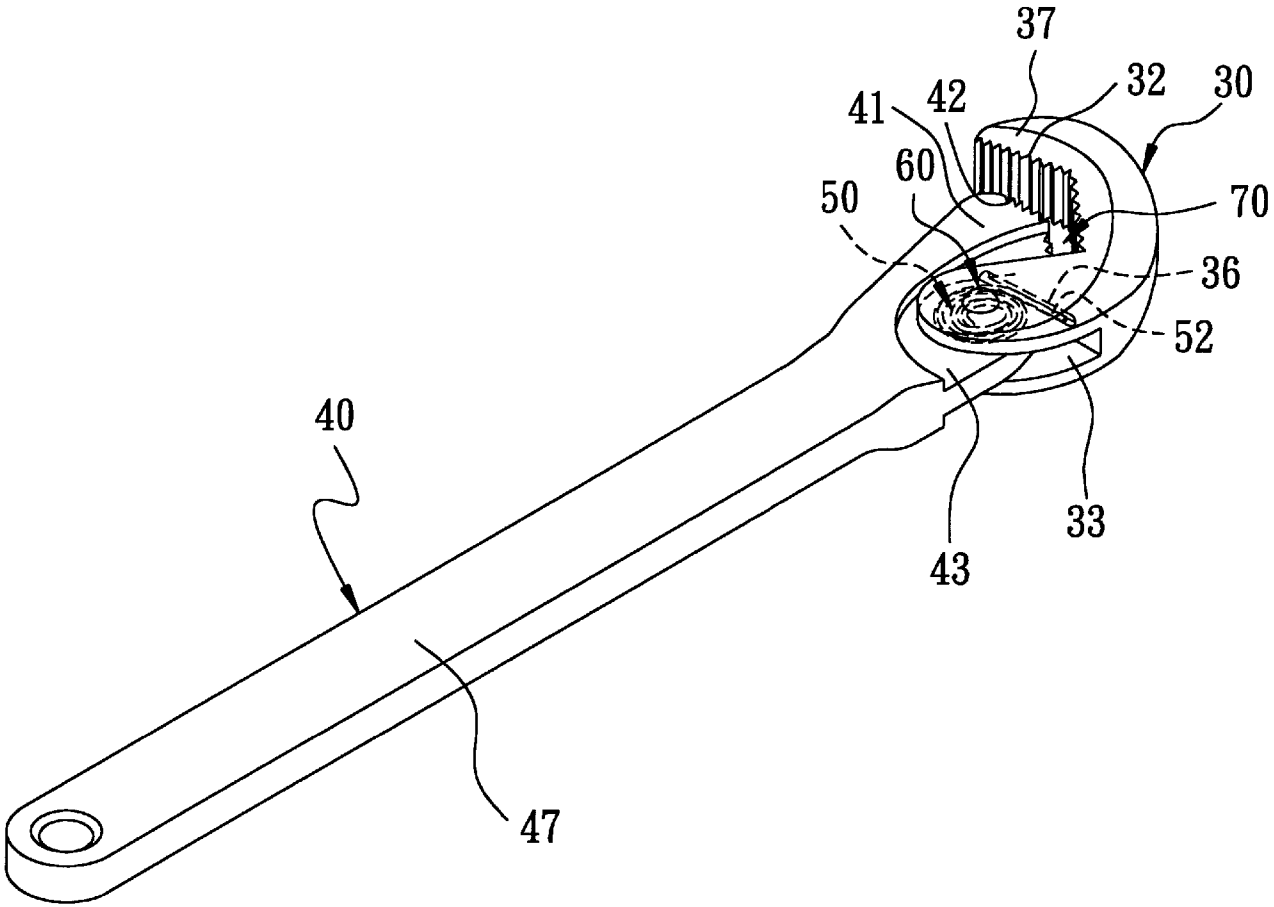
FIG. 6 is a perspective view of the preferred embodiment.

Referring to FIGS. 5 and 6, the preferred embodiment of a spanner according to the present invention is shown to include an elongated first clamping member 40, a second clamping member 30, a pivot shaft 60, and a torsion spring 50.

The first clamping member 40 has a handle portion 47 and a first jaw portion 41 formed on one end of the handle portion 47. The first jaw portion 41 has a toothed end face formed as a first clamping surface 42, and a pivot plate portion 43 extending from the first clamping surface 42. The pivot plate portion 43 has top and bottom surfaces 431, 432, and a first pivot hole 44 formed through the top and bottom surfaces 431, 432. The top surface 431 is formed with an annular recess confining wall 451 that defines a circular recess 45 around the first pivot hole 44, and an insert hole 46 disposed in the recess 45 and offset from the first pivot hole 44.

The second clamping member 30 has a second jaw portion 37, and a pair of spaced-apart pivot lobes 34 which extend from the second jaw portion 37 and which cooperate with the second jaw portion 37 to define a multi-angled opening 31. The second jaw portion 37 has a toothed and angled face which confronts the opening 31 and which serves as a second clamping surface 32. The pivot lobes 34 cooperatively define a receiving space 33 therebetween, and are formed with aligned second pivot holes 35. Each of the pivot lobes 34 has an inner surface which confronts the other one of the pivot lobes 34. The inner surface of an upper one of the pivot lobes 34 is formed with an elongated retaining groove 36 that extends from a first lateral edge portion 341 of the pivot lobes 34 toward an opposite second lateral edge portion 342 of the pivot lobes 34. The retaining groove 36 extends along the inner surface of the upper one of the pivot lobes 34, and has an open end 361 formed at the first lateral edge portion 341 and a closed end 362 opposite to the open end 361.

The pivot shaft 60 extends through the first and second pivot holes 44, 35 for mounting pivotally the pivot plate portion 43 of the first clamping member 40 on the pivot lobes 34 of the second clamping member 30 such that the first clamping surface 42 confronts the second clamping surface 32.

The torsion spring 50 is sleeved around the pivot shaft 60, and is received in the recess 45 so as to be concealed by the recess confining wall 451 of the pivot plate portion 43 of the first clamping member 40. The torsion spring 50 has a first end with a first leg member 51 that is inserted into the insert hole 46 in the recess 45 for retention at the pivot plate portion 43 of the first clamping member 40, and an opposite second end with a second leg member 52 that is received in the retaining groove 36 for retention at the upper pivot lobe 34 of the second clamping member 30. The torsion spring 50 biases the second jaw portion 37 of the second clamping member 30 to move toward the first jaw portion 41 of the first clamping member 40 so as to move the second clamping surface 32 toward the first clamping surface 42.

During assembly, the torsion spring 50 is received in the recess 45, thereby allowing the first leg member 51 to be inserted into the insert hole 46. At this time, the second leg member 52 extends outwardly of the recess 45 along the top surface 431, and projects relative to the second clamping surface 42. Then, the pivot plate portion 43 is inserted into the receiving space 33 in a direction from the first lateral edge portion 341 toward the second lateral edge portion 342 of the pivot lobes 34 so as to align the first pivot hole 44 with the second pivot holes 35. During the insertion of the pivot plate portion 43 into the receiving space 33, the second leg member 52 of the torsion spring 50 extends into the retaining groove 36 via the open end 361 of the retaining groove 36 and abuts against the closed end 362. The second leg member 52 thus guides the insertion of the pivot plate portion 43 into the receiving groove 33. Thereafter, the pivot shaft 60 is extended through the first and second pivot holes 44, 35, and is retained at the pivot lobes 34 by means of a rivet joint. As shown in FIG. 6, after assembly, a clamping space 70 is formed between the first and second clamping surfaces 42, 32.

Figure 9:
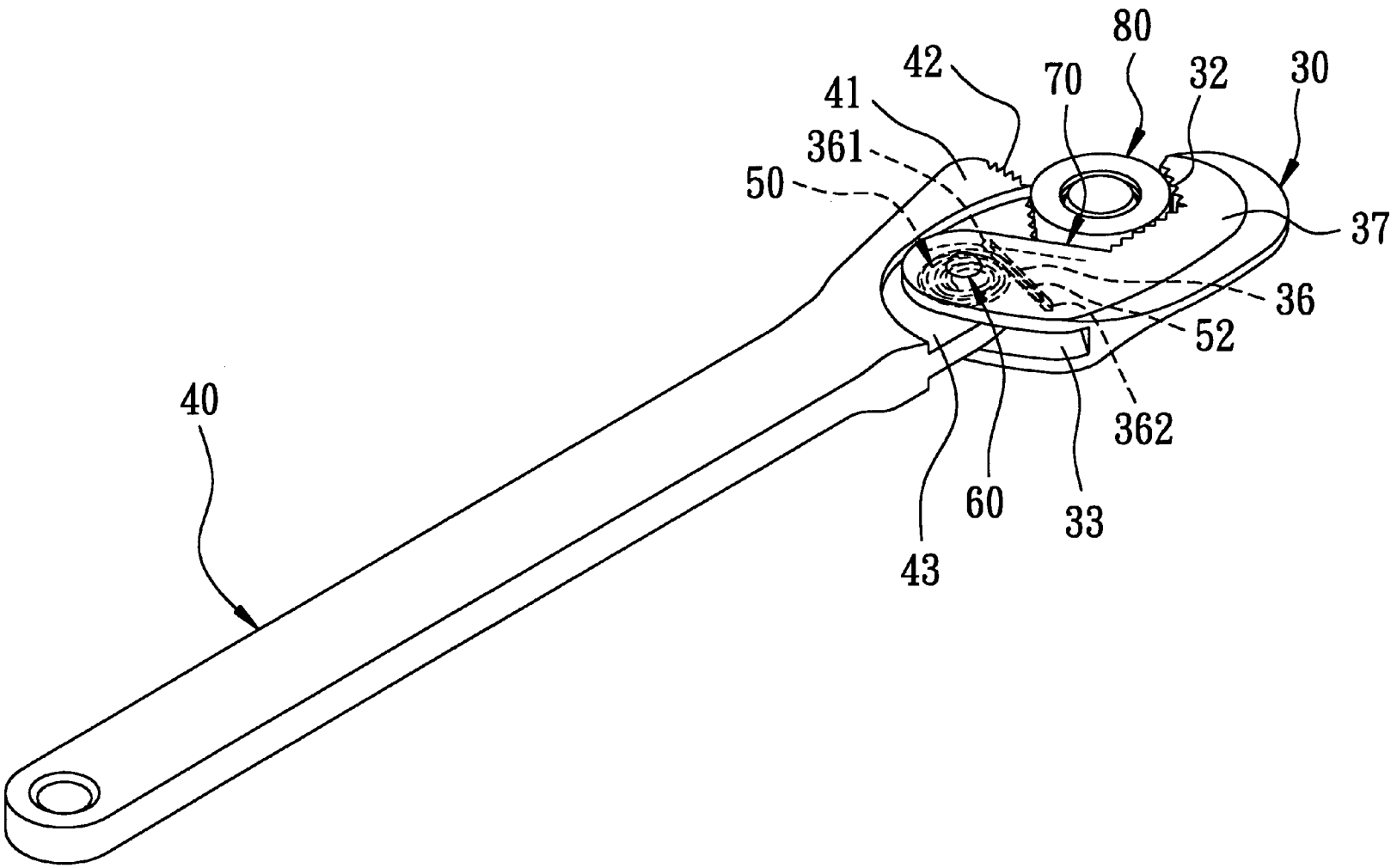
FIG. 9 is a perspective view of the preferred embodiment when in use.

Referring to FIG. 9, in use, a pulling force is applied to the second clamping member 30 to cause the second jaw portion 37 to pivot about the pivot shaft 60 in a direction away from the first jaw portion 41 so as to permit a workpiece 80, such as a screw fastener, to extend into the clamping space 70. At this time, the torsion spring 50 is wound, and a restoring energy is stored in the torsion spring 50. The pulling force is released after the workpiece 80 is extended into the clamping space 70. The second jaw portion 37 thus moves immediately toward the first jaw portion 41 due to the restoring force of the torsion spring 50. The workpiece 80 can thus be clamped tightly by the first and second clamping surfaces 42, 32.

Figure 7:
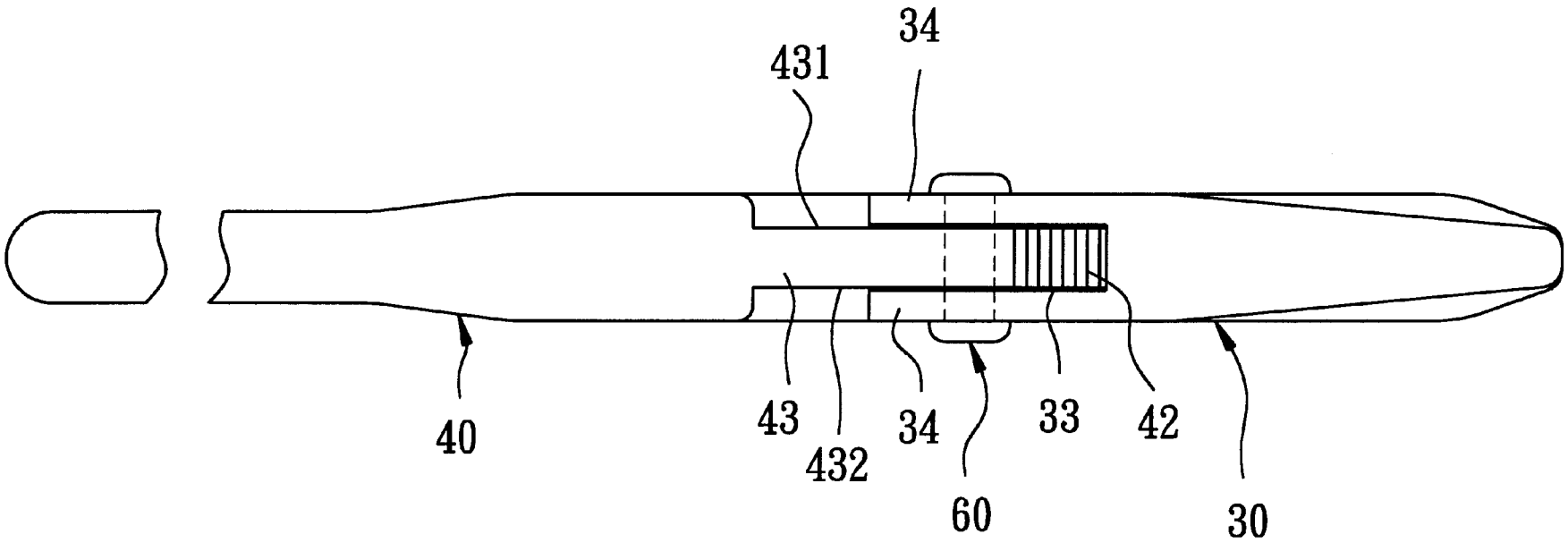
FIG. 7 is a schematic side view of the preferred embodiment.
Figure 8:
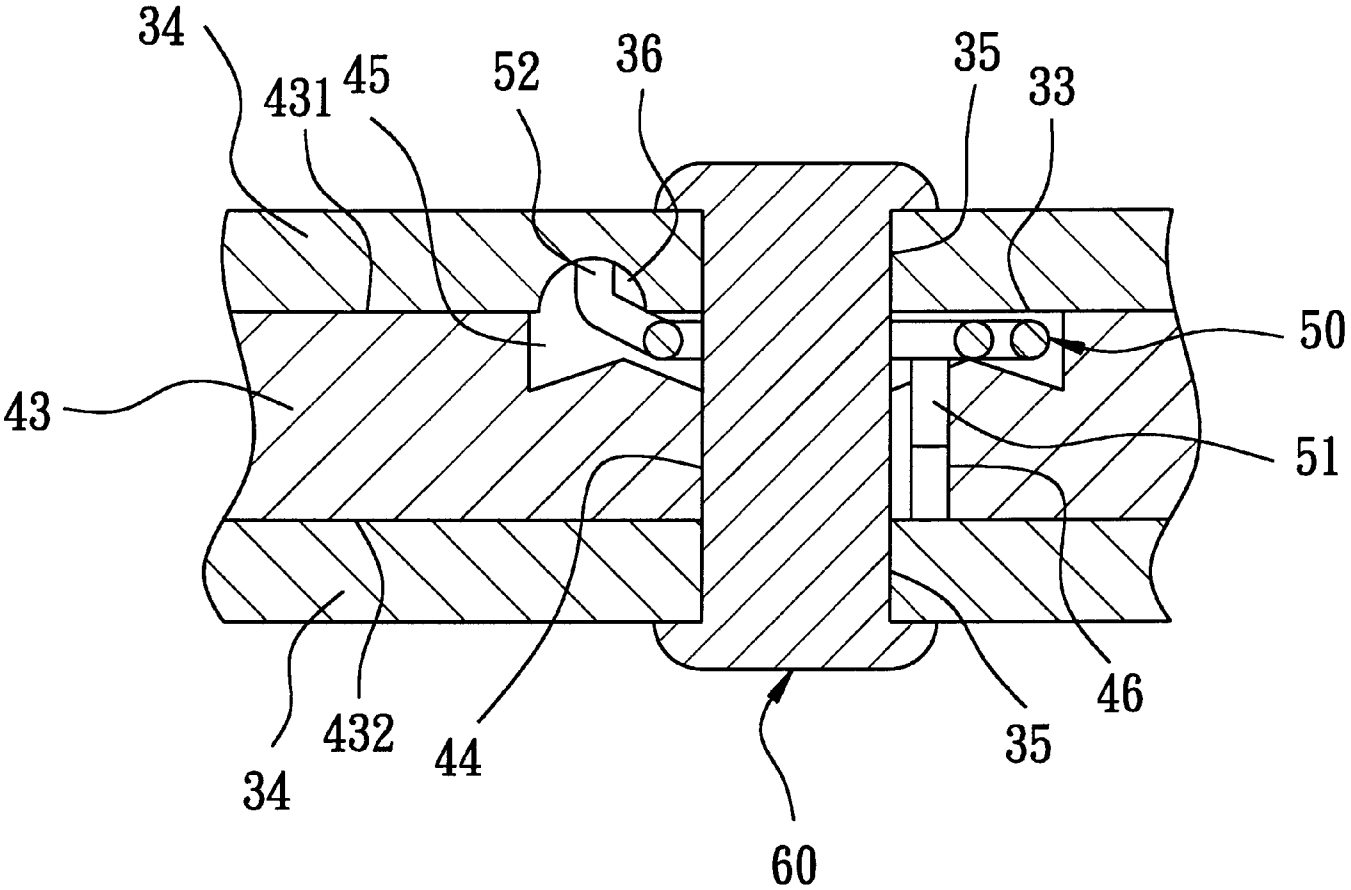
FIG. 8 is a fragmentary sectional view of the preferred embodiment.

As shown in FIGS. 7 and 8, since the torsion spring 50 is received in the recess 45, and since the second leg 52 of the torsion spring 50 can be inserted into the retaining groove 36 via the open end 361 (see FIG. 5) during assembly, the thickness of the pivot plate portion 43 of the first clamping member 40, measured between the top and bottom surfaces 431, 432, can be increased to be substantially identical to the width of the receiving space 33 measured between the confronting inner surfaces of the pivot lobes 34. Therefore, the pivot plate portion 43 has an increased strength as compared to the aforementioned conventional spanner.

In addition, because the pivot plate portion 43 has an increased thickness, the surface area of the first clamping surface 42 is increased correspondingly to achieve an enhanced clamping effect.

Moreover, since the second leg member 52 does not extend out of the receiving space 33, the torsion spring 50 can be isolated from an article disposed adjacent to the spanner. The biasing action of the torsion spring 50 can be ensured.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A spanner comprising:

an elongated first clamping member having a first jaw portion and a handle portion connected to said first jaw portion, said first jaw portion having a pivot plate portion with top and bottom surfaces and a first pivot hole formed through said top and bottom surfaces, said pivot plate portion having a thickness measured between said top and bottom surfaces;

a second clamping member having a second jaw portion and a pair of pivot lobes connected to said second jaw portion, said pivot lobes cooperatively defining a receiving space therebetween to permit said pivot plate portion of said first claiming member to extend thereinto, each of said pivot lobes being formed with a second pivot hole that is aligned axially with said first pivot hole, each of said pivot lobes having an inner surface that confronts the other one of said pivot lobes, said receiving space having a width which is measured between said inner surfaces of said pivot lobes;

a pivot shaft extending through said first and second pivot holes for mounting pivotally said second claiming member on said first clamping member; and a torsion spring sleeved on said pivot shaft and disposed in said receiving space for biasing said second jaw portion of said second clamping member to move toward said first jaw portion of said first clamping member;

wherein one of said top and bottom surfaces of said pivot plate portion of said first clamping member is formed with a recess confining wall that defines a recess around said first pivot hole, said torsion spring being received in said recess so as to be concealed by said recess confining wall and having a first end retained at said first clamping member and a second end retained at said second clamping member, the width of said receiving space of said second clamping member being substantially equal to the thickness of said pivot plate portion of said first clamping member; and wherein said inner surface of a first one of said pivot lobes that confronts said recess is formed with a retaining groove which extends along said inner surface, said second end of said torsion spring having a leg member that is received in said retaining groove for retention at said second clamping member.

2. The spanner according to claim 1, wherein said first one of said pivot lobes has opposite first and second edge portions formed between inner and outer surfaces of the first one of the pivot lobes, said retaining groove extending from said first edge portion toward said second edge portion and having an open end formed at said first edge portion to permit insertion of said leg member of said second end of said torsion spring into said retaining groove when said pivot plate portion of said first clamping member is extended into said receiving space while said torsion spring is received in said recess.

3. The spanner according to claim 1, wherein said pivot plate portion of said first clamping member is further formed with an insert hole in said recess, said insert hole being offset from said first pivot hole, said first end of said torsion spring having a leg member which extends into said insert hole for retention at said pivot plate portion of said first clamping member.

* * * * *